US009625935B2

(12) United States Patent
Olson

(10) Patent No.: US 9,625,935 B2
(45) Date of Patent: Apr. 18, 2017

(54) POWERED WHEELCHAIR JOYSTICK HANDLES

(71) Applicant: Joseph J. Olson, Balimore, MD (US)

(72) Inventor: Joseph J. Olson, Balimore, MD (US)

( * ) Notice: Subject to any disclaimer, the term of this patent is extended or adjusted under 35 U.S.C. 154(b) by 142 days.

(21) Appl. No.: 14/446,941

(22) Filed: Jul. 30, 2014

(65) Prior Publication Data

US 2015/0033895 A1 Feb. 5, 2015

Related U.S. Application Data

(60) Provisional application No. 61/861,449, filed on Aug. 2, 2013, provisional application No. 61/896,271, filed on Oct. 28, 2013.

(51) Int. Cl.

| | |
|---|---|
| ***G05G 9/047*** | (2006.01) |
| ***G05G 1/58*** | (2008.04) |
| *G05G 5/05* | (2006.01) |
| *G05G 5/04* | (2006.01) |

(52) U.S. Cl.

CPC ..... *G05G 9/047* (2013.01); *G05G 1/58* (2013.01); *G05G 5/04* (2013.01); *G05G 5/05* (2013.01); *G05G 2009/04718* (2013.01); *Y10T 74/20201* (2015.01)

(58) Field of Classification Search

CPC ..... G05G 9/047; G05G 2009/04714; G05G 2009/04718; G05G 5/04; G05G 5/05

See application file for complete search history.

(56) References Cited

U.S. PATENT DOCUMENTS

| | | | | |
|---|---|---|---|---|
| 4,012,014 | A * | 3/1977 | Marshall | B64C 13/04 244/234 |
| 4,555,960 | A * | 12/1985 | King | G05G 9/047 200/6 A |
| 5,207,791 | A * | 5/1993 | Scherbarth | A63F 13/08 224/270 |
| 6,727,889 | B2 * | 4/2004 | Shaw | G06F 3/0338 345/161 |
| 8,044,934 | B2 * | 10/2011 | Arai | G05G 25/04 345/161 |
| 2005/0083297 | A1 * | 4/2005 | Duncan | A63F 13/06 345/156 |
| 2006/0176273 | A1 * | 8/2006 | Wolfe | G06F 3/0338 345/156 |

(Continued)

*Primary Examiner* — Terence Boes

(74) *Attorney, Agent, or Firm* — Ziolkowski Patent Solutions Group, SC

(57) ABSTRACT

One embodiment is a handle supporting a users hand having a large surface for the palm, a trough for the thumb, a protrusion between the thumb and first finger and flared edges to keep the hand from sliding. A support surface is coupled to the stem of a wheelchair joystick gimbal and is biased in forward driving. A second embodiment is a wheelchair joystick movable between forward and reverse positions while maintaining the same orientation relative to the user. A supporting surface is pivotally mounted to a gimbal stem fixed to the wheelchair. The handle pivots to remain in a neutral position with movement of the joystick. A bidirectional spring biases the handle toward a neutral position. A third embodiment comprises a pivot coupled to a gimbal stem and a cup coupled to the user. The assembly is completed by placing the cup over the pivot allowing for movement therebetween.

9 Claims, 9 Drawing Sheets

(56) References Cited

U.S. PATENT DOCUMENTS

| | | | | |
|---|---|---|---|---|
| 2008/0184836 | A1* | 8/2008 | Riwan | G05G 9/04737 74/471 XY |
| 2009/0095108 | A1* | 4/2009 | Payandeh | B25J 13/02 74/480 R |
| 2010/0242654 | A1* | 9/2010 | Corney | G05G 1/04 74/471 XY |

* cited by examiner

NEUTRAL

FORWARD

REVERSE

NEUTRAL

FORWARD

REVERSE

POWERED WHEELCHAIR JOYSTICK HANDLES

RELATED APPLICATIONS

The present patent application is related to U.S. provisional patent application filed Aug. 2, 2013 as U.S. Ser. No. 61/861,449 and U.S. provisional patent application filed Oct. 28, 2013 as U.S. Ser. No. 61/896,271, both entitled "Lightweight Ergonomic Joystick Handle" and priority is claimed to both of the aforesaid provisional patent applications and the disclosures of both applications are hereby incorporated herein in their entirety by reference.

FIELD OF THE INVENTION

This invention relates to methods and devices designed to facilitate the operation of motorized wheelchairs, and more particularly, to adaptive wheelchair joysticks or joystick handles configured to provide an improved user interface for controlling the operation and movement of a motorized vehicle, such as a motorized wheelchair.

BACKGROUND OF THE INVENTION AND RELATED ART

Various advancements in motorized vehicles, namely motorized wheelchair technology, have enabled many persons with motor impairments and/or fatigue to be more independent; wherein the user is able to manipulate or control the movements of the wheelchair as desired without assistance from another. The implementation of programmable electronics and a variety of adaptive control devices have enabled self driving for many new wheelchair users. Despite these advancements, challenges still are encountered or presented in providing an optimal interface between the user and the control components of the wheelchair designed to control the operation of its automated systems.

The most common interface device is a single stem gimbal type joystick that is vertically oriented and attached to a support, such as an armrest. The gimbal stem is constrained to tilt approximately 30 degrees from vertical in any direction during operation. This allows for continuously variable control over direction and speed. For example, when the gimbal stem is tilted forward, a signal is sent to the wheelchair's controller that is interpreted as a forward drive command.

The joystick is usually controlled by grasping a small rubberized knob covering the end of the joystick gimbal stem. While the gimbal type of joystick is simple in design and provides an adequate control interface for many users, there are several inherent problems associated with this type of interface. To use this interface, a user must have the dexterity required to grasp the joystick to effectively manipulate the joystick as intended. Trying to manipulate a gimbal type joystick can be frustrating for an individual who has lost some or most motor skills. Because there is only a single protuberance, users with no finger dexterity usually drive with the knob between their thumb and first digit metacarpal. With little or no grasp, it is easy for the hand of a user to slip over the joystick during forward driving, and off the side of the joystick when turning.

Also, going over a small hump can cause the user to lose the grip on the joystick causing the chair to stop abruptly. This abrupt stopping could throw the user out of their chair or expose the user to danger while crossing streets. In addition, driving in reverse is impossible without repositioning the hand to apply a backwards force to the joystick. When driving backwards there are no analogous anatomic features to the thumb notch to provide effective lateral manipulation leading to poor rearwards driving control. Those with adequate motor skills may feel this type of interface device adequate, but it may be difficult and frustrating, or even dangerous for users who have little finger function. Many alternate interfaces with revolved surfaces (balls, cones, domes etc.) are available to assist those with weak grasp but they do not alleviate the described issues for those with no grasp.

Another type of interface device incorporates a handle with two protuberances rising vertically from each end of a horizontal cross member. This handle is coupled to a joystick gimbal stem medially beneath the cross member parallel to the protuberances making it medially and sagittally symmetrical. Thus the handle can be used by either hand. It is commonly referred to as a "goal post" style joystick handle. Most users rest their palms flat on the cross member between the protuberances which constrains lateral slipping of the palm. One protuberance rests in the notch between thumb and palm and the other protuberance secures the palm around the metacarpal of the last digit. The thumb remains unsupported. The goal post joystick provides significant improvement over the single protuberance joystick in that it is more ergonomically correct for the user, and requires less motor skills to manipulate effectively. The cross member serves as the primary interface for the user, with the protuberances providing additional support and functioning as secondary interface components. The user can push with the palm on the cross member to control forward motion and apply a force to the two lateral protuberances to control turning and apply corrective signals. The users fingers are positioned in front of the cross member, which in combination with increased hand contact (which leads to increased friction), facilitates backwards driving without need of hand repositioning.

Despite its advantages, one of the problems with the "goal post" joystick just described, as with the single stem gimbal joystick in that it may be uncomfortable to manipulate either type of joystick over long periods of time leading to fatigue, as both types were designed to facilitate manipulation not improve comfort. They are often fabricated by professionals such as occupational therapists for a specific user which is slow and expensive.

Another difficulty with providing an optimal handle is the changing orientation in respect to the user resulting from the gimbal stem moving through its range of motion during operation.

Many users of power wheelchairs who have hand weakness also have wrist weakness. Frequently users wear splints to improve wrist stability but the splints do not allow for wrist flexion. They also partially obstruct the palm. Other users wear apparatus' on their arms to combat contractures or spasticity. These devices do not allow the wrist to flex as the gimbal stem goes through its range of motion making it impossible to maintain full contact between handle and palm.

As such, both the single gimbal joysticks and the goal post joysticks, as described above, lack features that would optimize manipulation of the Joystick, and therefore control of the wheelchair movements.

It would, therefore, be advantageous to provide a wheel chair joystick that overcomes the deficiencies and ergonomic issues of the aforesaid devices.

SUMMARY OF THE INVENTION

In light of the problems and deficiencies inherent in the prior art, the present exemplary embodiments seek to overcome these difficulties by providing a wheelchair joystick handle comprised of various assistive features that allow the user to better manipulate the joystick, as well as a comfortable means of support.

FIRST EMBODIMENT

This exemplary embodiment is a lightweight, aesthetically pleasing, asymmetric (left or right handed) and ergonomic joystick with a scalable architecture soil efficiently fits most size hands. It is easily produced by injection molding or rapid prototyping methods. Due to the universal design and scalable fitting based on palm width, it does not require special fitting by a professional.

In other embodiments, it can be utilized for, but not limited to, gaming consoles, heavy machinery, driving assist fixtures and haptic controllers.

An exemplary embodiment of the invention features a joystick handle with an ergonomic upper surface that mirrors the contours of the human hand. The upper surface is designed to distribute pressure over a maximal surface of the hand by mimicking nearly the entire palm's natural contours, thereby decreasing localized pressure areas. A protrusion is formed n the upper surface and is adapted to be located between the thumb and fingers of the user's hand. The protrusion constrains the hand from sliding forward off of the handle. There are two support surfaces, one for the thumb and the other for the palm of the hand, on either side of the protrusion. The outer edges of the surfaces are upturned to keep the thumb and hand from translating laterally. To keep the wrist at a neutral position the overall height is minimal and a few degrees (approximately 30 degrees) out of full wrist pronation at full forward, that is, the side to side motion of the wrist is oriented to be at about 30 degrees. This keeps the wrist from rotating past its natural range of motion when turning in the direction opposite of the driving hand.

As can be seen by this description, the overall upper surface of the joystick handle is asymmetrical, that is, it is designed to be used by the left hand, or right had, but not both since the protrusion must be off center in order to fit comfortably between the thumb and index finger of the user. According, being asymmetrical as described, the upper surface is non-ambidextrous.

A mounting socket couples the hand support surface to the gimbal shaft. The socket is positioned such that it is directly centered laterally and at or slightly rearward to the center of pressure of the contour contacting the hand at joystick full forward. This helps to keep the handle from rotating out of line with the users wrist while driving. The socket location is nearly under the joystick center of mass which minimizes accidental activation without driver input. As seen, the center of mass is not the geometric center of the upper surface of the joystick handle since, as described, the upper surface is asymmetrical. To minimize weight, the general wall thickness throughout the geometry is, but is not limited to, 1/10 of an inch. Holes or pockets may be present to further decrease weight and to allow air movement keeping the users hand dry.

Fatigue is most prominent when driving power wheelchairs for long periods of time. Usually, when driving for long distances the joystick is in the furthest forward (top forward speed) position. To improve comfort and to keep the hand from sliding forward of the joystick when driving at full speed, hand support surface is biased such that the troughs fit best when in the full forward position.

SECOND EMBODIMENT

The joystick of this exemplary embodiment is designed for comfort throughout a gimbal style joystick's full range of motion. In accordance with the present invention, therefore, there is a joystick handle for powered wheelchairs that includes a hinge joint which allows the surface of the handle supporting the hand to move independently of the gimbal stem. This provides the user the comfort of adjusting the handle to a neutral wrist flexion position while moving the joystick in the forward or reverse direction in the operation of the wheelchair. The surface which supports the hand is designed similar to that of the first embodiment.

The present exemplar embodiment uses a flexible curved element as a bi-directional spring to return the grip to a neutral position when the joystick is not in use. The spring also changes the location of the center of pressure at the hand support surface which more evenly distributes the pressure over the load bearing surfaces of the users hand.

As such, the range of motion is designed so that the hand can remain in the preferred neutral wrist flexion position even when the joystick gimbal stem is at a full forward or full reverse position. A stop may also be provided to keep the wrist from rotating beyond a comfortable range of motion at full forward and/or reverse. This stop may be designed to provide suspension for increased comfort when driving over rough terrain.

Other features of the present gimbal joystick will become more apparent in light of the following detailed description of a preferred embodiment thereof and as illustrated in the accompanying drawings.

THIRD EMBODIMENT

The joystick of this embodiment is made to meet the needs of persons who do not have the full palm available to interact with the handle. Many wheelchair users wear splints or cuffs on their driving hand for a variety of reasons. These devices often immobilize the wrist and cover the palm. The present invention consists of two pieces; a pivot which slides over the gimbal stem and a cup which is permanently or non-permanently attached to the users splint. When combined they form a hinge joint.

An enlarged boss in the center of the pivot (se FIGS. 7 and 8) keeps the cup from slipping laterally. Two rods protrude from both sides of the boss to provide a lever arm when turning.

The cup forms the top of the joint and holds the top surface of the pivot. It flares out from the base of the cup to make for easy alignment of the joint. The current embodiment has a flat plastic surface or tab which can be inserted into the cuff of a user's splint. The flat surface keeps the socket from rotating in the cuff.

These and other features and advantages of the present invention will become more readily apparent during the following detailed description taken in conjunction with the drawings herein.

DETAILED DESCRIPTION OF THE INVENTION

First Embodiment

Figure 1:
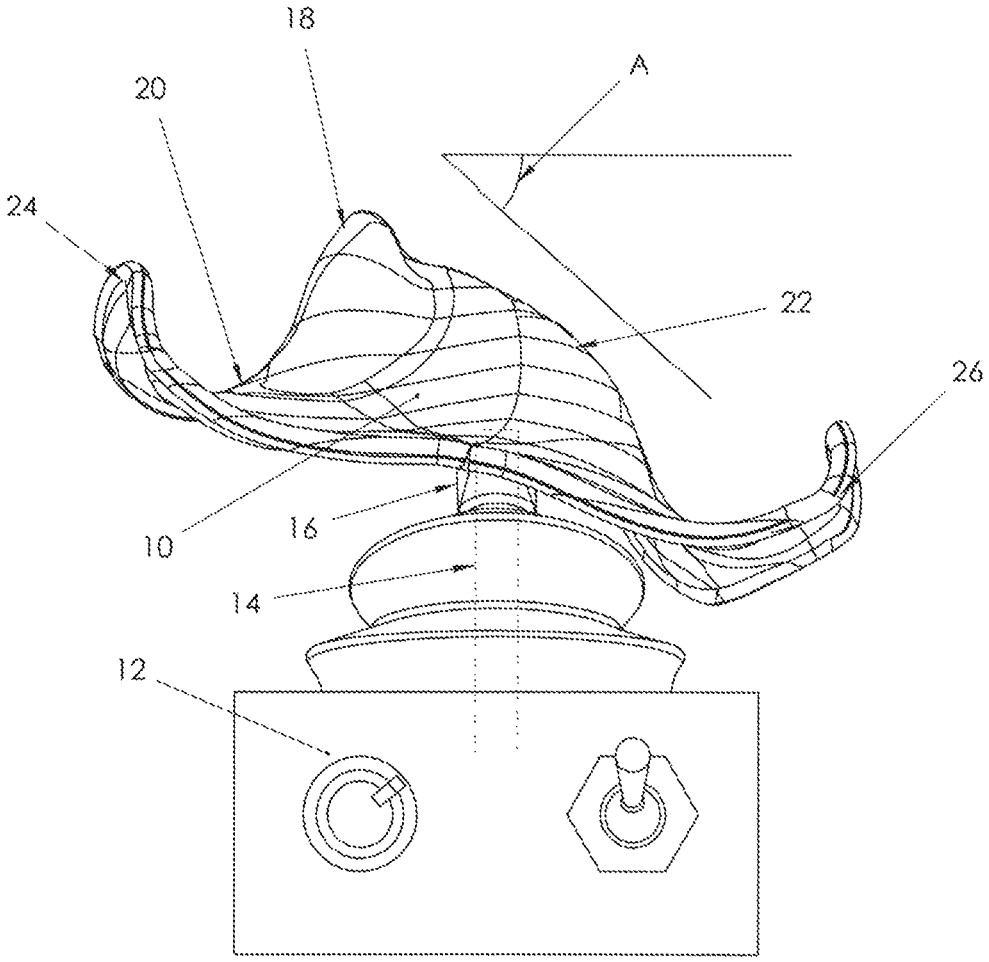
FIG. 1 is a rear elevation (user view) of a right-handed joystick handle of the first embodiment in full forward position (ergonomically neutral) coupled to a generic gimbal joystick. Contour lines are aligned with horizontal when the handle is in neutral are shown to give the reader a sense of the shape of the surface.

Turning to FIG. 1, there is shown a rear perspective view of the joystick handle 10 constructed in accordance with the present invention attached to a generic gimbal style joystick 12 with the gimbal stem 14 pushed to full forward. A socket 16 couples the joystick handle 10 to the gimbal stem 14. A protrusion 18 adapted to be located between the thumb and fingers of a user, constrains the user's hand from sliding forward off of the joystick handle 10 thus providing support to the extremity of the user. The joystick handle 10 thus provides two support surfaces, that is, a thumb support surface 20 and a palm support surface 22 for the users hand, on either side of the protrusion 18 with upturned edges 24, 26 of the thumb support surface 20 and the palm support surface 22, respectively.

The upturned edges 24, 26 provide lateral support and security for the thumb and hand of a user. The thumb support surface 20 and the palm support surface 22, respectively, provide contoured contact with the user's hand when the gimbal stem 14 is pushed to the full forward position, as shown in FIG. 1. The handle is biased to favor full forward gimbal stem orientation because it is the position that is held for long periods of time when driving for long distances when fatigue is most prevalent.

The contours of the support surfaces 20, 22 are designed to distribute pressure over a maximal surface of the user's hand by mimicking the hand's natural contours so as to decrease localized pressure areas. As such, the overall height of the joystick handle 10 is minimal and within a few degrees of full pronation (approximately 30° see reference angle A shown in FIG. 1) keeping turning to the inside (turning to the left when driving with your right hand) within the wrists comfortable range of motion.

Figure 2A:
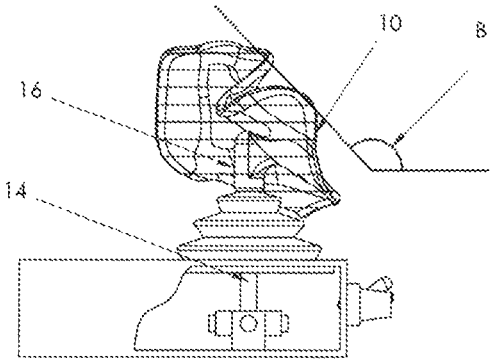
FIGS. 2A-2C are a side view of the joystick in the neutral position, a side view of the joystick in the full forward position and a top view of the joystick in the neutral position.
Figure 2B:
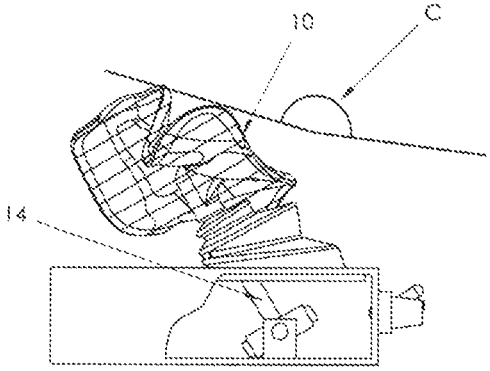
Figure 2C:
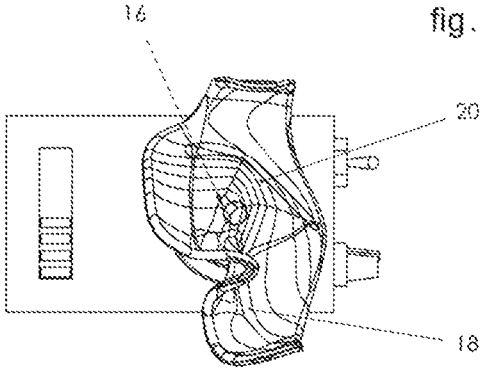

Turning to FIG. 2A-2C, there are shown, respectively, two side prospective views and a top view illustrating the joystick handle 10 of the present invention. In FIG. 2A, the gimbal stem 14 is illustrated in a neutral position (stem 14 is vertical in respect to the joystick 12 this corresponds to at rest and no input) while, in FIG. 2B, the gimbal stem 14 is positioned in the full forward position. In the top view of FIG. 2C, the gimbal stem 14 is again in the neutral position. When the gimbal stem 14 is in the neutral position (FIG. 2A), the driving thumb support and palm support surfaces 20, 22 lean backwards compensating for the full forward range of the gimbal stem 14 and enabling the wrist of the user to be in a wrist flexion/extension neutral position when the gimbal stem is in full forward (FIG. 2B). Angles B and C shown in FIGS. 2A and 2B illustrate the wrist flexion. In the neutral gimbal stem 14 position (FIG. 2C) of the mounting socket ergonomic wheelchair joystick handle is positioned nearly directly under the joystick center of mass to avoid accidental activation without driver input.

Figure 3B:
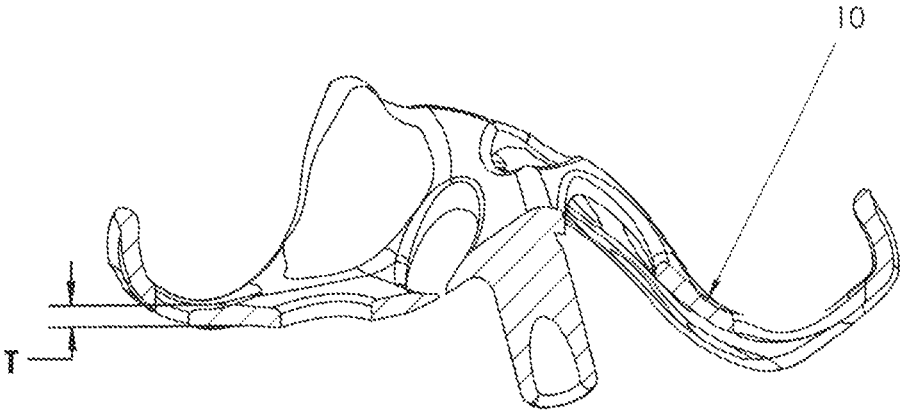
FIG. 3A is a top view of the joystick of the present invention and FIG. 3B is a cross sectional view taken along the line A-A of FIG. 3A.
Figure 3A:
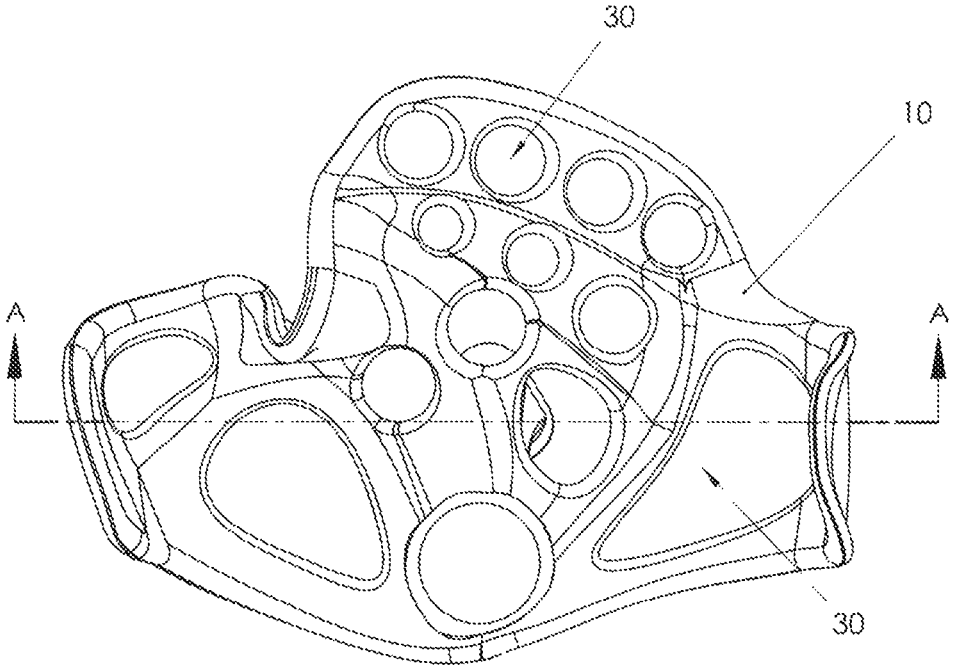

Turning to FIGS. 3A and 3B, FIG. 3A is a top view of a modified joystick handle 10 constructed in accordance of the first embodiment and FIG. 3B is a cross sectional view taken along the line A-A of FIG. 3A. As can be seen in FIG. 3B, the general wall thickness "T" throughout the geometry is preferably, but not limited to, 1/10 of an inch to minimize weight, thus further reducing risk of activation without user input.

Holes or pockets 30 may be present in the joystick stick handle 10 to decrease the weight and to allow air movement so as to keep the users hand dry. To keep the wrist at a neutral position the overall height is minimal and a few degrees (approximately 30 degrees) out of full wrist pronation at full forward, that is, the side to side motion of the wrist is oriented to be at about 30 degrees. This keeps the wrist from rotating past its natural range of motion when turning in the direction opposite of the driving hand.

As can be seen, the overall upper surface of the joystick handle 10 is asymmetrical, that is, it is designed to be used by the left hand, or right hand, but not both since the protrusional 18 must be off center in order to fit comfortably between the thumb and index finger of the user. According, being asymmetrical as described, the upper surface is non-ambidextrous.

Second Embodiment

Figure 4:
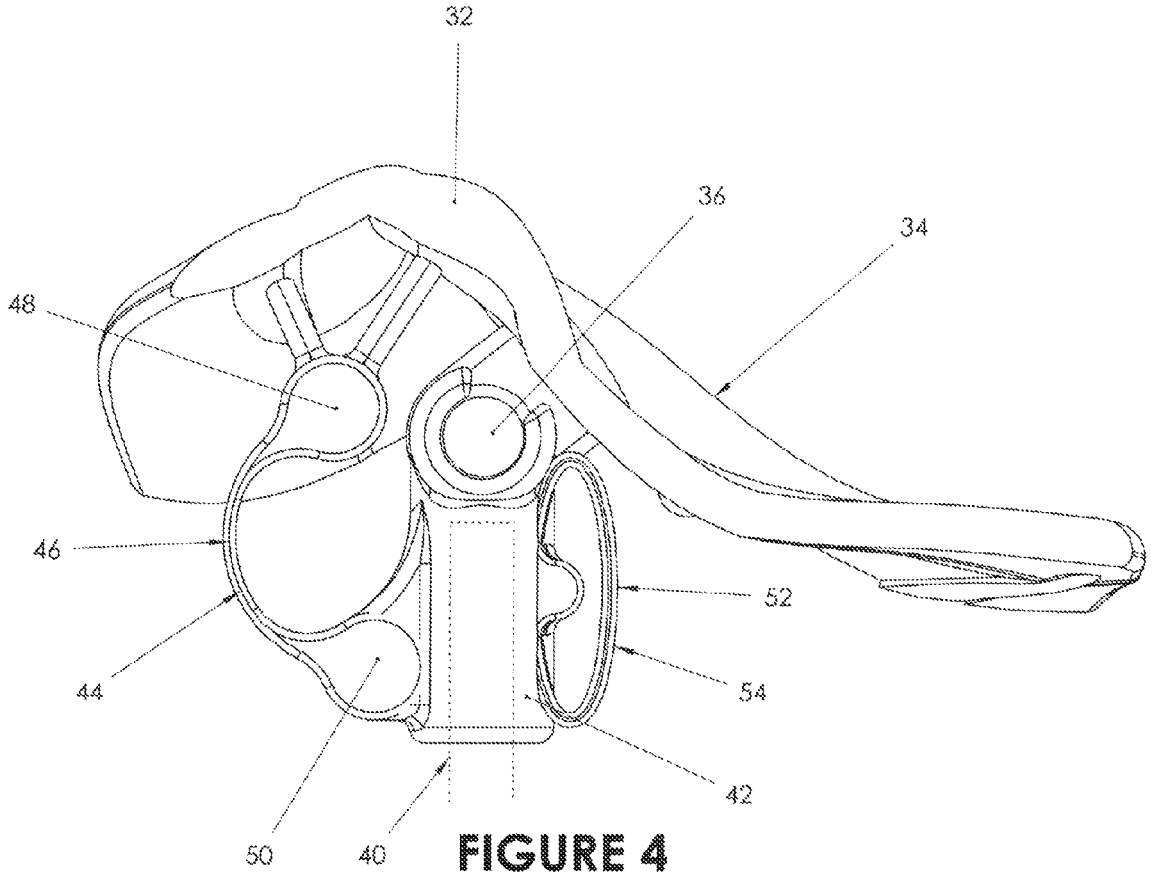
FIG. 4 is a side perspective view of the joystick constructed in accordance with the second embodiment.

Turning next to FIG. 4, there is shown a side perspective view or a joystick handle 32 constructed in accordance with the present invention wherein a hand interface 34 is adapted to be contacted by the hand of the user in operating the joystick as in the exemplary embodiment of FIG. 1. A hinge joint 36 allows the hand interface 34 to move independently with respect to the gimbal stem 40 but only in one plane. The joystick handle 32 is coupled to the gimbal stem 40 by a socket gimbal stem 42.

As such, the user has the comfort of neutral wrist flexion position while moving the joystick 32 to different positions. There is also a bi-directional spring 44 that is a flexible curved element to return the hand interface 34 to a neutral position when the joystick handle 32 is not in use.

As can be seen, the bi-direction spring 44 is comprised of a center curved element 46 and a pair of pin joints 48, 50 located at the opposed ends of the center curved element 46 with the pin joint 48 attached to the hand interface 34 and the pin joint 50 attached to the gimbal stem socket 42. Accordingly, as the hand interface 34 rotates clockwise around the hinge joint 36 in FIG. 4, the center curved element 46 is flexed outwardly, biasing the hand interface 34 toward its neutral position. In a similar fashion, as the handle 34 is rotated counterclockwise, the center curved element 44 is flexed inward to again bias the handle 34 toward its neutral position.

The bi-directional spring 42 thus changes the location of the center of pressure at the hand interface 34 from alignment with the center of rotation to a point away from the hinge joint 36 which more evenly distributes the pressure over the load bearing surface of the users hand.

A stop 52 is also included to limit the range of motion of the hand interface 34. A flexible center curved element 54 of stop 52 can compress to provide suspension for increased comfort when driving over rough terrain.

Figure 5A:
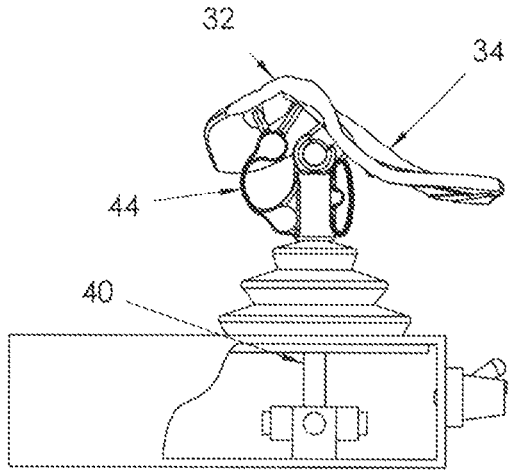
FIGS. 5A, 5B and 5C are side, schematic views illustrating the joystick of FIG. 4 in various operative positions.
Figure 5B:
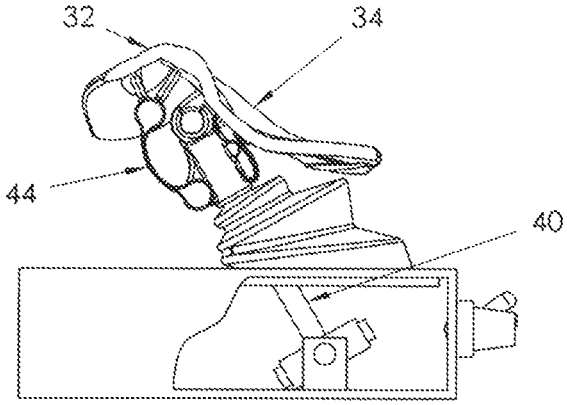
Figure 5C:
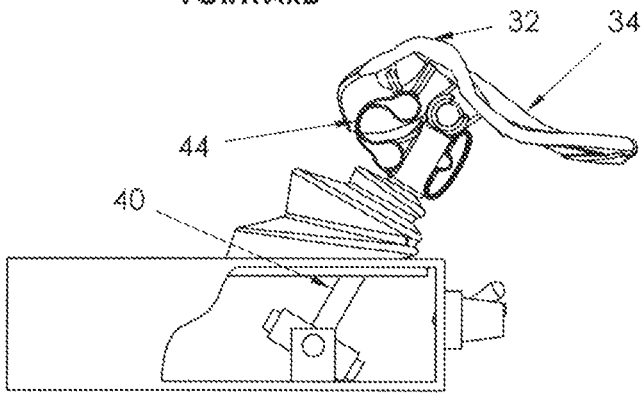

Turning then to FIGS. 5A-5C, there is shown, the joystick 32 in three representative orientations. In FIG. 5A, the joystick 32 and gimbal stem 40 can be seen in neutral position, in FIG. 5B, the joystick handle 32 and gimbal stem 40 are in the forward position and in FIG. 5C, the joystick 32 and gimbal stem 40 are in the reverse position. As such, it can be seen that the hand interlace 34 remains in a generally neutral position despite the orientation of the gimbal stem 40 so that the user's wrist is not stressed. The bi-directional spring 44 tends to bias the hand interface 34 to its neutral orientation.

Figure 6A:
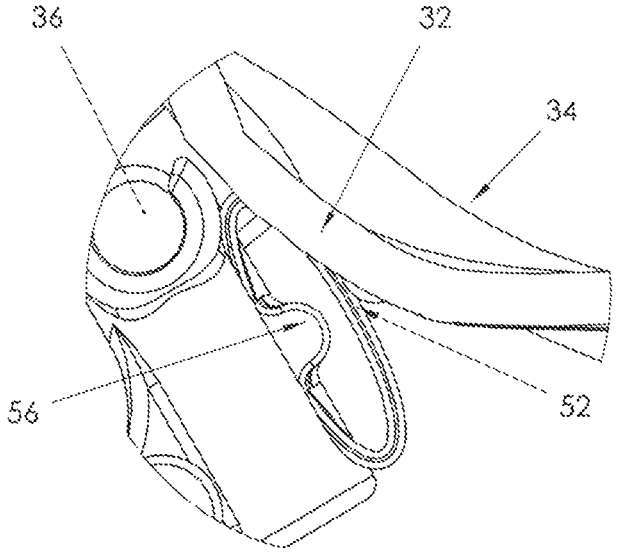
FIGS. 6A and 6B are side, schematic views illustrating the joystick of FIG. 4 in showing the operation of the stop.
Figure 6B:
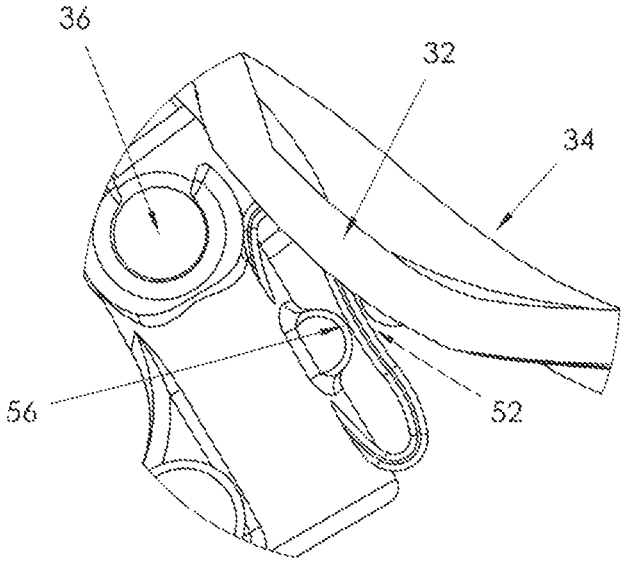

FIGS. 6A and 611 show the operation of the suspended stop 52. As the hand support surface 34 rotates around the hinge joint 36 of the joystick handle 32, the joystick handle 34 contacts the stop 52. Since the stop 52 is comprised of a plastic band, when higher forces are applied, the plastic band of the stop 52 flexes until the band contacts the hard stop 56. This provides an auxiliary rotational range of motion which is accessible when inadvertent large forces are applied such as when the user experiences large jolts when driving over uneven terrain.

Third Embodiment

In this exemplary embodiment, the joystick is constructed to meet the needs of persons who do not have the full palm available to interact with the handle. Many wheelchair users wear splints or cuffs on their driving hand for a variety of reasons. These devices often immobilize the wrist and cover the palm. This embodiment consists of two principle components, that is, a pivot 60 that slides over the gimbal stem 76 (FIGS. 9A-9C) and a cup 68 that is permanently or non-permanently attached to the user. When combined they form a joystick assembly.

Figure 7A:
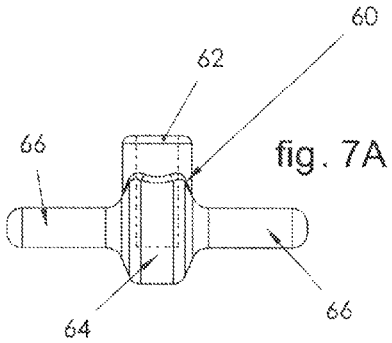
FIGS. 7A-7H are front, side, bottom and isometric views of the pivot and cup as described in a third embodiment.
Figure 7B:
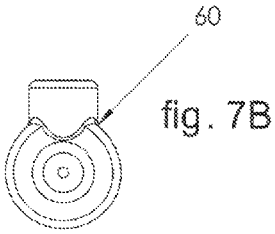
Figure 7C:
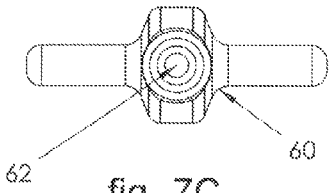
Figure 7D:
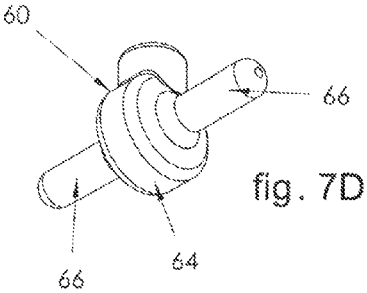
Figure 7E:
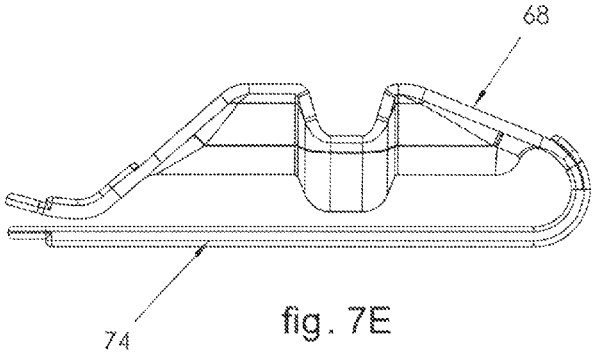
Figure 7F:
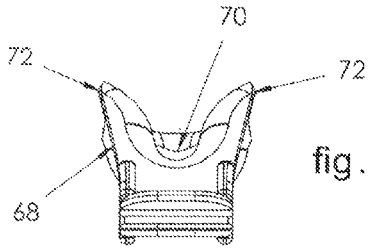
Figure 7G:
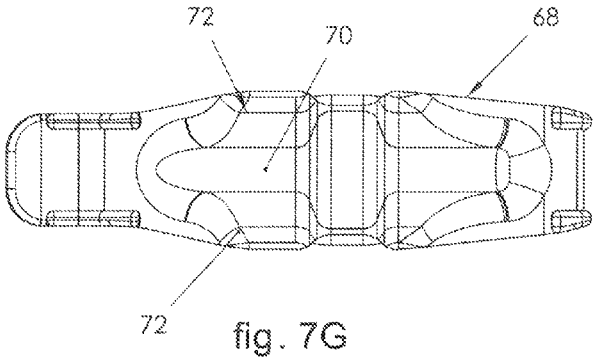
Figure 7H:
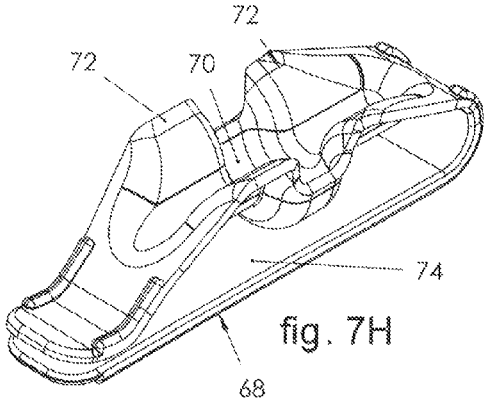

FIGS. 7-7H show front bottom and isometric views of the two components of this embodiment. FIGS. 7A-7D show the pivot 60 and FIGS. 7E-7H show the cup 68.

Figure 9A:
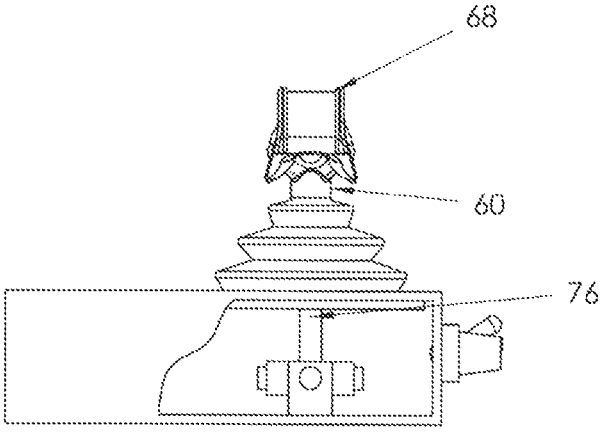
FIGS. 9A-9C are side, schematic views illustrating the joystick embodiment of FIGS. 7A-7H in various operative positions.
Figure 9B:
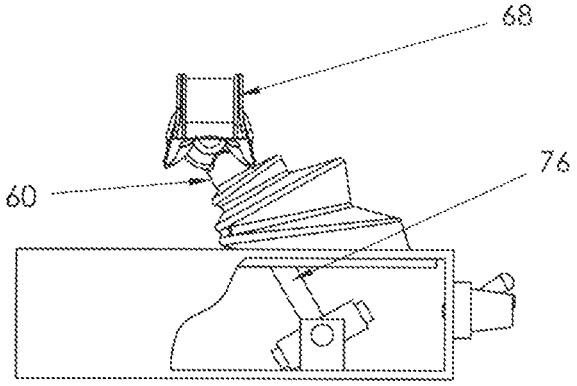
Figure 9C:
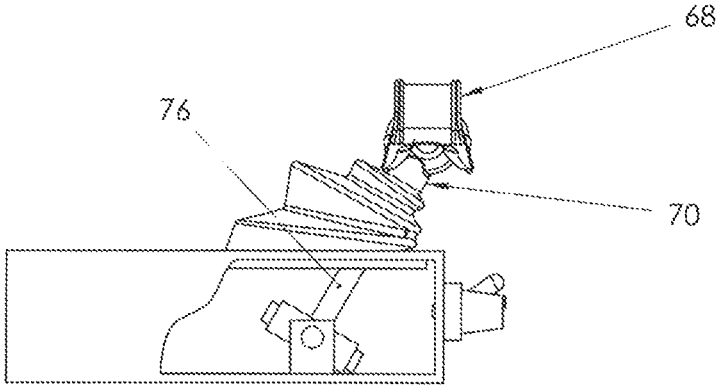

The pivot 60 consists of three main features, that is, a socket 62 which fits over is gimbal joystick stem 76 (FIGS. 9A-9C). An enlarged cylindrical boss 64 is formed as the center bearing surface of the hinge joint. The sides of this boss 64 provide much of the stabilization keeping the cup 68 from sliding axially. In addition, it centers the junction of the pivot 60 and the cup 68. The mounting socket 62 extends into the boss 64 decreasing overall height. The edges or the boss 64 are tapered to facilitate assembly of the joint. Two rods 66 protrude from both sides of the boss 62. These rods 66 provide the user lever arms to lean the gimbal stem left and right while turning.

The cup 68 consists of three main features, that is, a bearing surface 70 that is a concave surface which with an enlarged center area and, when the binge assembly is assembled, forms the contact between the pivot 60 and the cup 68. A flaring region comprising flares 72 facilitates the combining of the pivot 60, arms 66 and the cup 68. To facilitate coupling the cup 68 to a user, a wide flat tab 74 approximately as wide as the cap 68 (thin side shown in FIG. 7E) is provided. The tab 74 can be fit into the flat pocket of a universal cuff (not shown) that is attached to the arm of a user. The width and flatness of the tab 74 decreases the tendency of the tab to spin in the cuff.

Figure 8:
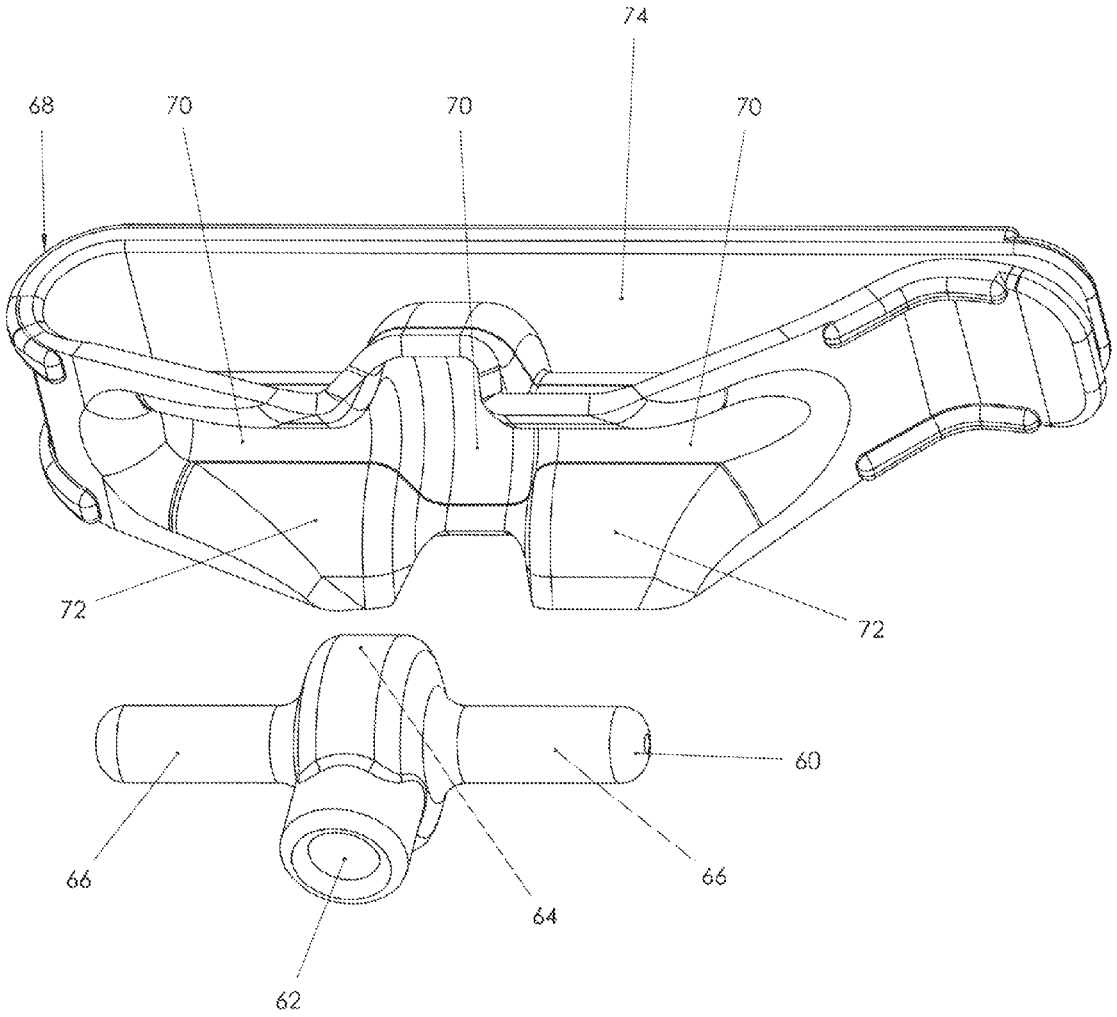
FIG. 8 is an exploded view illustrating the connection of the pivot and cup of the FIG. 7A-7H embodiment.

FIG. 8 is an exploded view illustrating the assembly of the joystick assembly. The joystick assembly is assembled by placing the cup 68 over the pivot 60. It is disassembled by lifting the cup 68 off the pivot 60. As can be seen, the flares 72 of the cap 68 and taper of the boss 64 facilitate alignment.

FIGS. 9A-9C show lateral views of the third embodiment installed on a generic gimbal joystick with the joystick assembly fully assembled. The figures show the gimbal stem 76 in three positions: forward (FIG. 9A), neutral (FIG. 9B) and reverse (FIG. 9C). The three figures demonstrate how the joystick assembly allows a user to maintain a constant wrist orientation throughout the full forward/reverse range of the gimbal stem 76 when the cup 68 is attached to the user. By attaching the cup 68 to the user instead of the pivot 60, the user is able to emergency stop by lifting their hand of without binding regardless of the orientation of the gimbal stem 76. This also maintains a consistent feel throughout the range of motion of the gimbal stem 76 by having a constant bearing surface size and orientation.

Those skilled in the art will readily recognize numerous adaptations and modifications which can be made to the joystick embodiments of the present invention which will result in an improved device and method of using the same, yet all of which will fall within the scope and spirit of the present invention as defined in the following claims. Accordingly, the invention is to be limited only by the following claims and their equivalents.

The invention claimed is:

1. A joystick comprising a handle having an upper surface contoured to and adapted to support the hand of a user and a gimbal stem, the handle being pivotally attached to the gimbal stem by a single axis pivot joint to constrain the movement of the handle in only one plane with respect to the gimbal stem as the gimbal stem moves between a forward position and a rearward position with a neutral position about midway intermediate the forward and rearward positions to allow a wrist of a user to maintain a neutral position when the gimbal stem moves between the forward and rearward positions.

2. The joystick of claim 1 wherein a bi-directional spring is interposed between the handle and the gimbal stem that biases the upper surface of the handle toward the neutral position.

3. The joystick of claim 2 wherein the bi-directional spring has a curved center element and a pair of pin joints at opposed ends of the curved center element, one of the pin joints being affixed to the gimbal stem and the other of the pin joints being affixed to the handle wherein the flexing of the curved center element biases the handle toward the neutral position.

4. The joystick of claim 1 further including a stop to limit the rotating movement of the handle.

5. The joystick of claim 1 wherein the upper surface of the handle is oriented to maximize user comfort for a gimbal stem orientation other then the neutral position.

6. The joystick of claim 1 wherein the upper surface of the handle is oriented to provide partial wrist pronation at the gimbal stem orientation for maximal comfort.

7. The joystick of claim 4 wherein the stop comprises a flexible member that compresses inwardly when the handle pushes against the flexible member to limit the movement of the handle.

8. The joystick of claim 7 wherein the stop further has a hard stop that limits the inward movement of the flexible member.

9. The joystick of claim 1 wherein the upper surface has a protrusion, adapted to be located between a thumb and fingers of a hand of a user, the upper surface further having upturned outer edges and a pair of support surfaces, one of the support surfaces adapted to support a thumb of a user and the other support surface adapted to support a palm of a hand of a user, both of the support surfaces having contoured troughs adapted to contact and distribute pressure over a maximal surface of the hand of a user.

* * * * *